US012509268B2

(12) United States Patent
Garthaffner et al.

(10) Patent No.: US 12,509,268 B2
(45) Date of Patent: Dec. 30, 2025

(54) METHOD AND APPARATUS FOR PRODUCING POUCHED TOBACCO PRODUCT

(71) Applicant: Philip Morris USA Inc., Richmond, VA (US)

(72) Inventors: Martin T. Garthaffner, Richmond, VA (US); Barry Smith, Hopewell, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 18/767,139

(22) Filed: Jul. 9, 2024

(65) Prior Publication Data

US 2024/0359852 A1 Oct. 31, 2024

Related U.S. Application Data

(60) Continuation of application No. 18/327,242, filed on Jun. 1, 2023, now Pat. No. 12,077,336, which is a (Continued)

(51) Int. Cl.
*B65B 61/00* (2006.01)
*B65B 9/20* (2012.01)

(Continued)

(52) U.S. Cl.
CPC ..... *B65B 61/24* (2013.01); *B65B 9/2028* (2013.01); *B65B 9/213* (2013.01); *B65B 37/08* (2013.01);

(Continued)

(58) Field of Classification Search
CPC ..... B65B 9/213; B65B 9/2028; B65B 37/08; B65B 51/16; B65B 51/26; B65B 61/24; B65B 63/026
See application file for complete search history.

(56) References Cited

U.S. PATENT DOCUMENTS 2,160,367 A * 5/1939 Maxfield ..... B65B 31/045 53/511
2,372,406 A 3/1945 Treneer (Continued)

FOREIGN PATENT DOCUMENTS

DE 2109834 A1 * 9/1972
JP H04-228056 A 8/1992

(Continued)

OTHER PUBLICATIONS

English translation of Russian Office Action dated Dec. 5, 2014, of Russian Application No. 2012132451/13.

(Continued)

*Primary Examiner* — Eyamindae C Jallow
(74) *Attorney, Agent, or Firm* — Harness, Dickey & Pierce, P.L.C.

(57) ABSTRACT

In a method and apparatus for producing a small pouch with a predetermined amount of particulate material therein, a predetermined amount of the particulate material is portioned from a bulk supply and compacted into a single discrete caplet. The caplet is then deposited into an open hollow pouch closed at one end thereof, and the open end is then closed with the caplet between the closed ends of the pouch. The caplet in the pouch is then compressed to return it to its particulate form. The particulate material may be granular or shredded tobacco.

19 Claims, 1 Drawing Sheet

Related U.S. Application Data continuation of application No. 17/831,640, filed on Jun. 3, 2022, now Pat. No. 11,691,775, which is a continuation of application No. 17/034,463, filed on Sep. 28, 2020, now Pat. No. 11,383,873, which is a continuation of application No. 15/967,222, filed on Apr. 30, 2018, now Pat. No. 10,807,753, which is a division of application No. 12/979,426, filed on Dec. 28, 2010, now Pat. No. 9,957,075.

(60) Provisional application No. 61/291,119, filed on Dec. 30, 2009.

(51) Int. Cl.

| | |
|---|---|
| ***B65B 9/213*** | (2012.01) |
| ***B65B 37/08*** | (2006.01) |
| ***B65B 61/20*** | (2006.01) |
| ***B65B 61/24*** | (2006.01) |
| *B65B 51/16* | (2006.01) |
| *B65B 51/26* | (2006.01) |
| *B65B 63/02* | (2006.01) |

(52) U.S. Cl.

CPC ..... *B65B 61/20* (2013.01); *B65B 51/16* (2013.01); *B65B 51/26* (2013.01); *B65B 63/026* (2013.01)

(56) References Cited

U.S. PATENT DOCUMENTS

| | | | | |
|---|---|---|---|---|
| 2,478,505 | A | 8/1949 | Salfisberg | |
| 2,987,987 | A | 6/1961 | Raney | |
| 3,394,870 | A * | 7/1968 | Curtis | B65D 77/08 493/202 |
| 3,450,529 | A | 6/1969 | MacDonald | |
| 3,517,480 | A | 6/1970 | Pinkham | |
| 3,603,058 | A | 9/1971 | Schubert | |
| 3,674,397 | A | 7/1972 | Harris | |
| 3,731,451 | A | 5/1973 | Sexstone et al. | |
| 3,734,659 | A | 5/1973 | Harris | |
| 3,824,054 | A | 7/1974 | Harris | |
| 3,833,327 | A | 9/1974 | Pitzer et al. | |
| 3,901,635 | A | 8/1975 | Greenberger | |
| 4,845,922 | A * | 7/1989 | Sweere | A61F 13/2085 53/134.1 |
| 5,174,088 | A | 12/1992 | Focke et al. | |
| 5,286,321 | A | 2/1994 | Fuss | |
| 6,254,911 | B1 | 7/2001 | Komatsu | |
| 6,402,496 | B2 | 6/2002 | Ishikawa et al. | |
| 6,427,425 | B1 | 8/2002 | Nakagawa et al. | |
| 7,032,601 | B2 | 4/2006 | Atchley et al. | |
| 7,247,013 | B2 | 7/2007 | Roland | |
| 8,122,893 | B2 | 2/2012 | Boldrini | |
| 10,308,379 | B2 | 6/2019 | Bierschenk et al. | |
| 10,308,385 | B2 | 6/2019 | Bierschenk et al. | |
| 11,089,815 | B2 | 8/2021 | Persson et al. | |
| 2002/0119874 | A1 | 8/2002 | Heitmann et al. | |
| 2007/0261707 | A1 | 11/2007 | Winterson et al. | |
| 2008/0202532 | A1 | 8/2008 | Wygal | |
| 2010/0071711 | A1 | 3/2010 | Boldrini | |
| 2010/0101189 | A1 | 4/2010 | Boldrini | |
| 2010/0252056 | A1 | 10/2010 | Gruss et al. | |
| 2011/0232232 | A1 * | 9/2011 | Rinehart | A24B 13/00 53/562 |
| 2011/0303232 | A1 | 12/2011 | Williams | |
| 2012/0252647 | A1 * | 10/2012 | Pastore | A24D 3/0287 198/470.1 |

FOREIGN PATENT DOCUMENTS

| | | | |
|---|---|---|---|
| JP | 2000-281141 | A | 10/2000 |
| RU | 2289999 | C1 | 12/2006 |
| RU | 2294675 | C2 | 3/2007 |
| WO | 2008/114122 | A2 | 9/2008 |

OTHER PUBLICATIONS

Packaging Machine MP-2; Machine Design & Electro-Mechanical Engineering; www.nastecgmi.com/MP2.pdf (Author Unknown).

International Search Report and Written Opinion of International Application No. PCT/IB2010/003473 mailed Sep. 14, 2011.

International Preliminary Report on Patentability for PCT/IB2010/003473 dated Jul. 4, 2012.

* cited by examiner

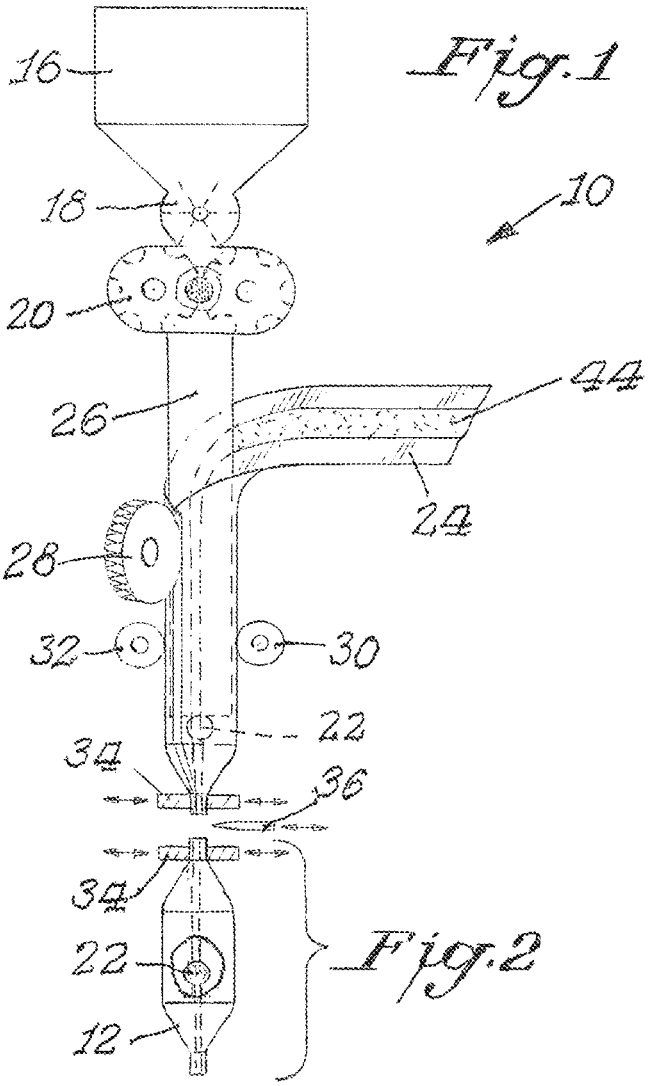
Fig. 1
Fig. 2
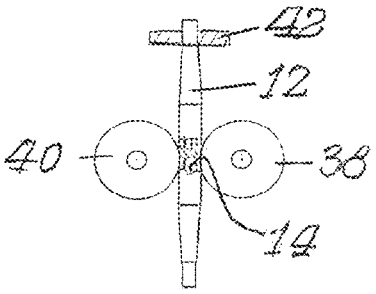
Fig. 3

METHOD AND APPARATUS FOR PRODUCING POUCHED TOBACCO PRODUCT

CROSS REFERENCE TO RELATED APPLICATION

This application is a continuation of U.S. patent application Ser. No. 18/327,242, filed Jun. 1, 2023, which is a continuation of U.S. patent application Ser. No. 17/831,640, filed Jun. 3, 2022, which is a continuation of U.S. patent application Ser. No. 17/034,463, filed Sep. 28, 2020, which is a continuation of U.S. patent application Ser. No. 15/967,222, filed Apr. 30, 2018, which is a divisional of U.S. patent application Ser. No. 12/979,426, filed Dec. 28, 2010, which claims the benefit of U.S. Provisional Application No. 61/291,119 filed Dec. 30, 2009, the entire contents of each of which are hereby incorporated by reference.

BACKGROUND OF THE INVENTION

The present invention relates to the production of a small pouch, and more particularly to a pouch with a precise amount of particulate material within the pouch.

Smokeless tobacco is often sold in small pouches designed for placement in the mouth of the user. In many instances granular or shredded tobacco is placed within an open pouch while the tobacco is in its particulate form, and this can lead to undesirable scattering of the particulate during handling and deposit into the pouch. Also, under high production speeds it is also difficult to deposit precise amounts of particulate material over long production runs. This causes inconsistency in the final product.

SUMMARY OF THE INVENTION

Accordingly, one of the objects of the present invention is the production of a small pouch with a precise amount of particulate material in the pouch.

Another object of the present invention is a procedure that is easy to follow and that consistently produces a small pouch with a precise amount of particulate material in the pouch.

Still another object of the present invention is an apparatus that functions in a highly efficient manner to produce small pouches, each with a precise amount of particulate material therein.

In accordance with the present invention, a method is provided for producing a small pouch with a predetermined amount of particulate material within the pouch. The various method steps include portioning a predetermined amount of particulate material from a bulk supply of such material, and compacting the predetermined amount of particulate material into a single discrete caplet. The caplet is then deposited into an open hollow pouch closed at one end thereof, and the pouch is later closed at the open end thereof with the caplet between the closed ends of the pouch. The discrete caplet is subsequently compressed in the pouch to return the caplet to a predetermined amount of particulate material.

The method may also include the step of placing a flavor strip in the pouch, and in a preferred embodiment, the pouch is formed from an endless strip of flexible material. The particulate material may be granular or shredded tobacco.

The present invention also includes apparatus for producing a small pouch with a predetermined amount of particulate material within the pouch. A bulk supply of particulate material is provided, and a portioning device receives a predetermined amount of particulate material from the bulk supply. A compressor then forms the predetermined amount of particulate material into a single discrete caplet, and a feeding device deposits the caplet into an open hollow pouch closed at one end thereof. A sealing device closes the pouch at the open upper end, and subsequently, a compressor engages the discrete caplet to return the caplet to its particulate form.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings, wherein similar reference characters refer to similar parts and in which:

FIG. 1 is a diagrammatic elevational view illustrating formation of a small pouch and the formation and deposit of a discrete caplet into the pouch, according to the present invention;

FIG. 2 is a diagrammatic elevational view illustrating closure of the upper end of the pouch after deposit of the caplet therein; and FIG. 3 is a further diagrammatic elevational view illustrating compression of the caplet to return the caplet to its particulate form.

DETAILED DESCRIPTION OF THE INVENTION

Referring in more particularity to the drawings, FIG. 1 illustrates an apparatus 10 for producing a small pouch 12 with a predetermined amount of particulate material 14 within the pouch. The apparatus may be used to produce smokeless tobacco products often sold in small pouches specifically designed for placement in the mouth of the user. In such cases the particulate material 14 may be shredded or granular tobacco.

The apparatus 10 includes a hopper 16 for holding a bulk supply of the particulate material 14. A portioning device 18 in the form of a meter receives a predetermined amount of particulate material 14 from the hopper 16, and a roll compactor 20 functions to compress the predetermined amount of particulate material 14 into a single discrete caplet 22.

The pouch 12 is formed from an endless web of flexible material 24 by wrapping that material around a hollow cylinder such as feed tube 26. The longitudinal edges of the web 24 are sealed together by a knurled sealing roller 28, and the pouch in its tubular form is delivered in a downstream direction by a pair of drive rollers 30, 32.

After formation of the discrete caplet 22 by the compactor 20, the caplet is deposited at a downstream location via the feed tube 26.

The tubular form of the web 24 is formed into a pouch by a sealing mechanism 34, which functions to close the lower end of the tube, as shown in FIG. 1. The formed tube is then cut by a reciprocating knife blade 36 at the closed end thereof. After such closure, the sealing mechanism moves away in an outward direction as illustrated by the arrows, and the web in its tubular form is driven in a downstream direction by the rollers 30, 32. The sealing mechanism 34 then engages the upper end of the pouch, whereby both ends of the pouch are closed with the caplet 22 therein.

The next phase of the operation is shown in FIG. 3, where compression rollers 38, 40 engage and compress the caplet to return it to its particulate form. This may be done by holding the upper end of the pouch 12 with a clamp 42, and moving the compression rollers 38, 40 in an upward or downward direction to pulverize the caplet and return it to its particulate form.

A flavor strip 44 may be included in each pouch 12 to impart a desired flavor to the granular or shredded tobacco 14 within the pouch. In this regard, an endless flavor strip may be provided on the web 24 of the pouch material so that subsequent cutting by knife blade 36 also cuts the flavor strip into a piece within each pouch.

The preferred embodiment may be practiced with poucher machines such as those manufactured by Merz Verpackungsmaschinen GmbH, Lich, Germany.

The invention claimed is:

1. An apparatus for forming an oral pouch product, the apparatus comprising:

a caplet forming device configured to form a caplet from a particulate material;

a feeding device configured to receive the caplet from the caplet forming device and direct the caplet into a flexible web;

a first sealing device configured to close the flexible web around the caplet so as to form a pouch having the caplet therein; and a compression device configured to engage the caplet so as to return the caplet to a particulate material, wherein the compression device includes a pair of compression rollers.

2. The apparatus of claim 1, wherein the caplet forming device is a roll compactor.

3. The apparatus of claim 1, further comprising:

a hopper configured to hold a supply of the particulate material.

4. The apparatus of claim 1, further comprising:

a supply of the flexible web.

5. The apparatus of claim 4, further comprising:

a supply of a flavor strip, at least a portion of the flavor strip on the flexible web.

6. The apparatus of claim 1, wherein the feeding device includes a hollow cylinder.

7. The apparatus of claim 1, further comprising:

a second sealing device configured to create a longitudinal seal on the flexible web.

8. The apparatus of claim 7, wherein the second sealing device includes a knurled sealing roller.

9. The apparatus of claim 7, wherein the second sealing device is configured to create the longitudinal seal when flexible web is around the feeding device.

10. The apparatus of claim 1, further comprising:

a drive roller configured to translate the flexible web.

11. The apparatus of claim 10, further comprising:

a pair of drive rollers including the drive roller.

12. The apparatus of claim 1, further comprising:

a cutting device configured to separate a portion of the flexible web from a remainder of the flexible web.

13. The apparatus of claim 12, wherein the cutting device includes a reciprocating knife blade.

14. The apparatus of claim 1, wherein the pair of compression rollers is configured to move longitudinally with respect to the pouch.

15. The apparatus of claim 1, further comprising:

a clamp configured to engage the flexible web.

16. The apparatus of claim 15, wherein the clamp is configured to engage an end of the pouch.

17. The apparatus of claim 1, wherein the first sealing device is configured to seal a first end of the pouch and a second end of the pouch.

18. An apparatus for forming an oral pouch product, the apparatus comprising:

a caplet forming device configured to form a caplet from a particulate material;

a feeding device configured to receive the caplet from the caplet forming device and direct the caplet into a flexible web;

a first sealing device configured to close the flexible web around the caplet so as to form a pouch having the caplet therein;

a compression device configured to engage the caplet so as to return the caplet to a particulate material; and a clamp configured to engage the flexible web, wherein the clamp is configured to engage the flexible web during compression of the caplet.

19. An apparatus for forming an oral pouch product, the apparatus comprising:

a hopper configured to hold a supply of a particulate material;

a supply of a flexible web;

a caplet forming device configured to form a caplet from the particulate material;

a first sealing device configured to create a longitudinal seal on the flexible web so as to form a tube of the flexible web;

a feeding device configured to receive the caplet from the caplet forming device and direct the caplet into the tube of the flexible web;

a drive roller configured to translate the tube of the flexible web;

a second sealing device configured to close the flexible web around the caplet so as to form a pouch having the caplet therein;

a cutting device configured to separate a portion of the flexible web from a remainder of the flexible web;

a clamp configured to engage the flexible web; and a compression device configured to compress the caplet so as to return the caplet to a particulate material, wherein the clamp is configured to engage the flexible web during compression of the caplet.

* * * * *